United States Patent [19]

Peace et al.

[11] 4,162,471

[45] Jul. 24, 1979

[54] ELECTROMAGNET LIFTING DEVICE

[75] Inventors: John Peace, Guisborough; Harold Wright, Stockton-on-Tees; Kenneth Clague, Guildford, all of England

[73] Assignee: British Steel Corporation, London, England

[21] Appl. No.: 831,875

[22] Filed: Sep. 9, 1977

[51] Int. Cl.[2] ..... H01F 7/20

[52] U.S. Cl. ..... 335/291; 294/65.5

[58] Field of Search ..... 335/289, 290, 291, 295; 294/65.5

[56] References Cited

U.S. PATENT DOCUMENTS

| | | | |
|---|---|---|---|
| 3,147,614 | 9/1964 | Scott | 335/289 X |
| 3,316,514 | 4/1967 | Radus et al. | 335/291 |
| 3,363,209 | 1/1968 | Pevar | 335/295 X |
| 3,968,986 | 7/1976 | Nagata | 294/65.5 |

FOREIGN PATENT DOCUMENTS

| | | | |
|---|---|---|---|
| 946863 | 8/1956 | Fed. Rep. of Germany | 294/65.5 |
| 1226263 | 10/1966 | Fed. Rep. of Germany | 335/291 |

*Primary Examiner*—George Harris

*Attorney, Agent, or Firm*—Bacon & Thomas

[57] ABSTRACT

An electromagnetic lifting device is provided with a pole piece of tapered or conical configuration extending outwardly from the load contacting surface of the magnet body. The tapered or conical configuration of the pole piece extends the effective magnetic flux pattern outwardly of the magnet body and also enables the pole piece to penetrate more readily into a collection of loose ferrous articles which are to be lifted.

9 Claims, 5 Drawing Figures

ELECTROMAGNET LIFTING DEVICE

BACKGROUND OF THE INVENTION

1. Field of the Invention

This invention relates to an electromagnetic lifting device of the type which may be utilised, for example, for the handling of scrap ferromagnetic material.

2. Prior Art and Technical Considerations

Flat circular electromagnets are used extensively for handling a wide range of ferrous products, for example, sheets, slabs and loose scrap. It is known that such electromagnets are extremely efficient in the handling of flat ferrous items such as sheets or slabs, but suffer a marked decrease in efficiency when utilised for the handling of small ferrous items such as mixed scrap shapes and swarf. For example, a 55 inch diameter electromagnet may be capable, under the same operating current conditions, of lifting a 20 ton ferrous slab but only be capable of lifting one ton of loose ferrous scrap or ½ ton of swarf.

OBJECT OF THE INVENTION

It is an object of the present invention to provide a new or improved electromagnetic lifting device having enhanced lifting properties with respect to ferrous scrap and swarf.

SUMMARY OF THE INVENTION

In accordance with the invention there is provided an electromagnetic lifting device for ferrous articles comprising a ferromagnetic body having an electromagnetic excitation winding contained therein and a ferromagnetic pole piece extending outwardly away from the body which is so shaped so as to be capable of penetration into a collection of loose ferrous articles.

The pole piece is preferably tapered and of conical configuration but may be of circular or polygonal cross-section conveniently comprising a three or four sided pyramidal configuration, for example. For the purposes of this specification and claims the term "conical" as used in relation to the pole piece will be understood to refer to pole pieces having cross-sectional configurations which may be circular, or elliptical. Moreover, pole piece may be hollow, part hollow or solid.

Preferably the pole piece is detachably securable to the load contacting surface of the body by for example, screw threads. Alternatively the pole piece may be welded to the load contacting surface of the body.

BRIEF DESCRIPTION OF THE DRAWINGS

Other features of the invention will become apparent from the following description given herein solely by way of example with reference to the accompanying drawings wherein like reference numerals refer to like parts throughout the several views and wherein.

DETAILED DESCRIPTION

Figure 1:
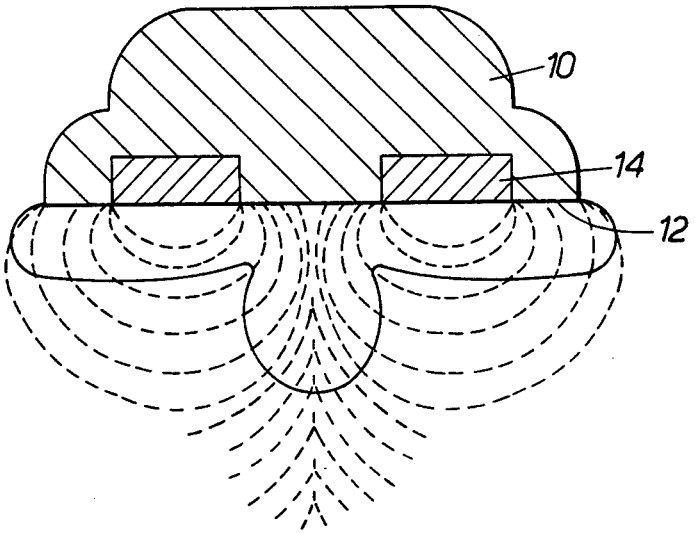
FIG. 1. PRIOR ART
FIG. 1 is a diagrammatic, side, cross-sectional view of a conventional prior art electromagnet, illustrating the effective flux pattern of magnetic lines of force.

The conventional electromagnet illustrated in FIG. 1 comprises the usual circular steel casting 10 having a flat circular load contacting surface 12 which, in use, comprises the under surface of the magnet. A coil 14 is located within the steel casting 10 in such manner that, when a D.C. electric current is passed through the coil, the casting 10 becomes magnetised having one pole adjacent the centre of the surface 12 and the other pole extending around the circumference of the casting. The magnetic lines of force created when the coil is energised are illustrated in dotted line in FIG. 1, and the effective flux pattern of such lines of force is encompassed generally within the volume bounded by the full line.

It will be seen from the illustration of this flux pattern that the electromagnet is eminently suitable for lifting flat ferrous items such as slabs or sheets which will lie close to the load contacting surface 12 of the electromagnet, whereas conversely, the magnet will not be as efficient for the lifting of a pile of ferrous scrap or swarf.

Figure 2:
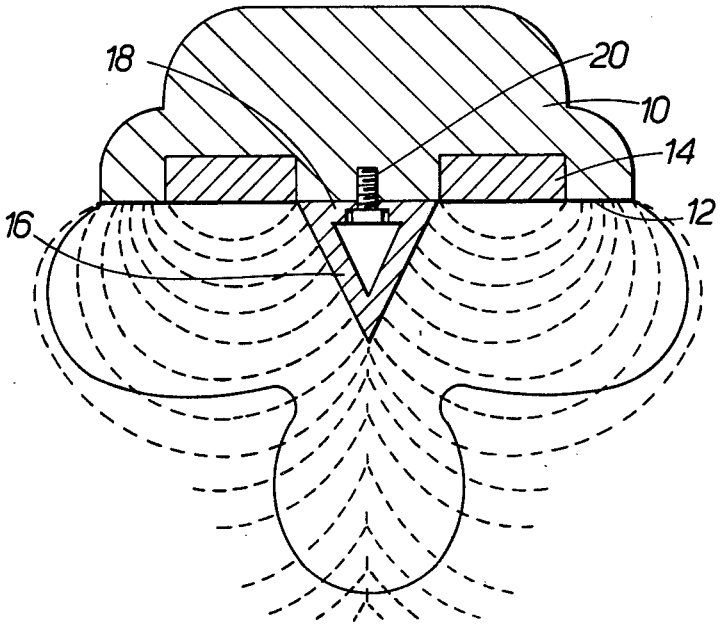
FIG. 2 is a diagrammatic, side, cross-sectional view of an electromagnet in accordance with the invention, illustrating the improved effective magnetic flux pattern.

An electromagnet in accordance with the invention is illustrated at FIG. 2 wherein an outwardly extending pole piece 16 of ferromagnetic material is detachably secured to the flat load contacting surface 12 of a conventional electromagnet. In this embodiment the pole piece 16 comprises a hollow tapered or conical shell having a base which tapers to an apex and being of ferromagnetic material detachably secured at its base 18 to the centre of the load contacting surface 12 of the electromagnet. As illustrated herein the shell 16 is conveniently secured to said surface 12 by means of an externally screw-threaded stud 20 fast with the base 18 of the shell for threaded engagement within a tapped bore in the surface 12 of the electromagnet. Preferably the pole piece is closed with a continuous exterior surface.

The provision of the projecting ferromagnetic shell 16 effectively increases the surface area of the center pole set up upon energization of the coil 14. With such an arrangement the magnetic lines of force generally follow the distribution pattern illustrated by the dotted lines in FIG. 2, the center pole being effectively constituted by the projecting shell 16. The effective flux pattern is thereby generally encompassed within the volume bounded by the full line in FIG. 2.

As is clearly shown, by comparison of FIGS. 1 and 2, the effective flux pattern of the electromagnet in accordance with the invention extends a distance increased considerably away from the load contacting surface 12 of the electromagnet over the whole of the surface. The effective flux patterns illustrated in FIGS. 1 and 2 show the effect of the projecting pole piece 16 on an electromagnet operating under the same current amperage applied to the coil 14. It will thus be seen that an electromagnet in accordance with the invention will have superior lifting capabilities with respect to a pile of ferrous items such as scrap or swarf.

It will be appreciated that the pole piece 16 may be detachably secured to the flat under surface 12 of the electromagnet by any suitable means compatible with ease of removal of the pole piece whereby the electromagnet may be selectively utilised for the handling of flat ferrous items such as sheets or slabs and as mentioned hereinbefore, the pole piece 16 may be alternatively of conical, elliptical or polygonal configuration and may be hollow, part hollow, or solid.

Figure 3:
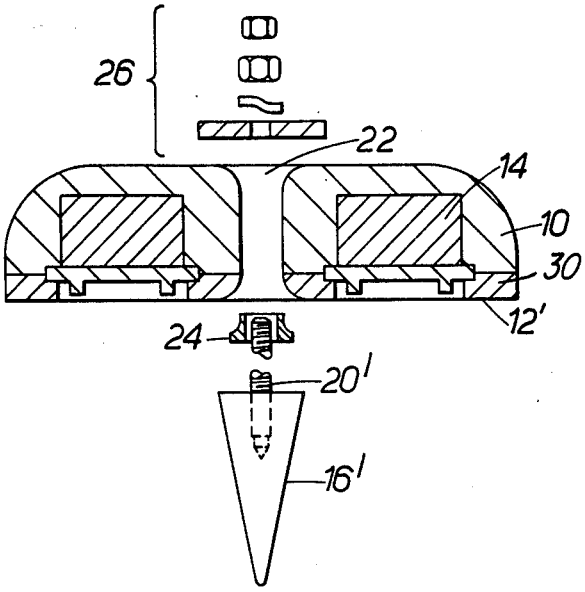
FIG. 3 is an exploded, diagrammatic, side, cross-sectional view showing an alternative form of electromagnet in accordance with the invention.

In an alternative embodiment of the invention illustrated in FIG. 3, a solid conical pole piece 16' is detachably secured to the under surface of a circular conventional electromagnet of the type provided with a central cylindrical bore 22 extending from the under surface 12' to the top surface of the magnet. The pole piece 16' is conveniently formed of a work hardening and wear resistant ferromagnetic material such as a manganese steel and is configured with a more acute apex angle than the shell 16 illustrated in FIG. 2. This more pointed apex and elongated configuration of the pole piece 16' enables it to penetrate more readily into a pile of scrap and/or swarf material, whilst at the same time the extension of the surface area of the pole piece 16' away from the under surface 12' of the magnet enables the additional flux pattern also to extend an increased distance away from the surface 12'.

The pole piece 16' is provided with threaded studding 20' extending from the base thereof and passing upwardly through a sheathing locating bush 24 to extend clear above the upper surface of the electromagnet where it is releasably secured by an appropriate lock nut and washer assembly 26.

Figure 4:
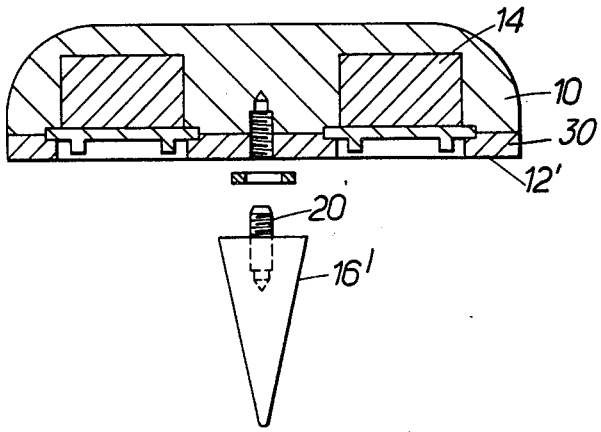
FIG. 4 is an exploded, diagrammatic side, cross-sectional view, showing a further alternative form of electromagnet in accordance with the invention.

In the further alternative embodiment illustrated in FIG. 4 a solid conical pole piece 16' of the type described and illustrated with respect to FIG. 3 is screw-threadedly secured directly into a tapped bore in the under surface 12 of the electromagnet substantially in the manner described and shown with respect to FIG. 2.

In all of the embodiments described and illustrated the pole piece 16 or 16' may be provided with a readily detachable and replaceable solid conical tip of a work hardening and wear resistant ferromagnetic material such as manganese steel. Conveniently such a tip may be secured to the apex of the main body of the pole piece, which would be of frusto-conical configureation by a simple screw-threaded connection.

Figure 5:
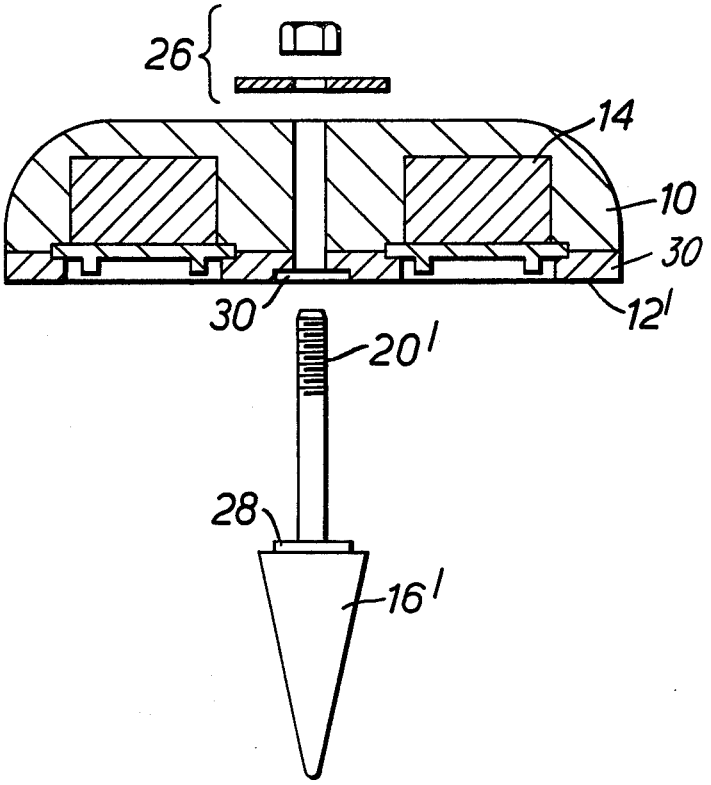
FIG. 5 is a diagrammatic side cross-sectional view showing a yet further alternative form of mounting for the pole piece on the body.

In the further embodiment illustrated in FIG. 5, a solid conical pole piece 16' is provided with integral threaded studding 20' passing upwardly through the magnet body to extend above its upper surface where it is releasably secured in position by an appropriate lock nut and washer assembly 26. In this construction the base of the pole piece 16' is provided with an integral raised spigot 28 surrounding the studding 20' to fit into a corresponding recess 30 on the under surface of the magnet body; such an arrangement providing greater physical strength to the assembly, particularly against lateral impact.

In the embodiments of FIGS. 3, 4 and 5, surface 12' is on a base plate 30 which actually forms part of the pole while the pole piece 16' forms a projecting tapered tip which is detachably held in abutment with the base plate.

We claim:

1. An electromagnetic lifting device for lifting loose ferrous articles comprising: a ferromagnetic body having an electromagnetic excitation winding contained therein and a relatively flat contacting surface, and a pole comprising a ferromagnetic pole piece extending outwardly away from the body, the pole piece having a relatively wide base abutting the contacting surface of the body and tapering to an apex remote from the base, whereby the pole piece can readily penetrate a collection of loose ferrous articles and cause the articles to be attracted to the pole piece.

2. The electromagnetic lifting device of claim 1 further including a base plate mounted on the body wherein the base plate forms part of the pole and wherein means are provided for detachably securing the pole piece to the base plate.

3. The electromagnetic lifting device of claim 1 wherein the pole piece is conical.

4. The electromagnetic lifting device of claim 1 further including means for detachably securing the pole piece to the body.

5. The electromagnetic lifting device of claim 4 wherein the securing means includes a threaded stud on the pole piece and a threaded socket in the body for threadably receiving the stud to detachably secure the pole piece to the body.

6. The electromagnetic lifting device of claim 4 wherein the securing means includes a threaded stud on the pole piece, a bore through the body and a threaded member for threadably engaging the stud to hold the stud within the bore after the stud has been inserted through the bore.

7. The electromagnetic lifting device of claim 1, wherein the pole piece is hollow.

8. The electromagnetic lifting device of claim 1, wherein the pole piece is solid.

9. An electromagnetic lifting device as claimed in claim 5 wherein the pole piece and stud are integral with one another and an integral spigot projects from the base of the pole piece and wherein a recess is disposed in the under surface of the body which corresponds in size to the spigot and receives the spigot when the pole piece is joined to the body.

* * * * *